US008172214B2

(12) United States Patent
Kubota et al.

(10) Patent No.: US 8,172,214 B2
(45) Date of Patent: May 8, 2012

(54) SHEET COLLECTING APPARATUS, POST PROCESSING APPARATUS AND IMAGE FORMATION SYSTEM

(75) Inventors: Ichitaro Kubota, Minamikoma-gun (JP); Kazuhiko Watanabe, Nirasaki (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 219 days.

(21) Appl. No.: 12/591,684

(22) Filed: Nov. 30, 2009

(65) Prior Publication Data

US 2010/0140861 A1 Jun. 10, 2010

(30) Foreign Application Priority Data

Dec. 9, 2008 (JP) ..... 2008-313597

(51) Int. Cl.
*B65H 39/00* (2006.01)

(52) U.S. Cl. ..... 270/58.1; 270/58.07; 270/58.11; 270/58.12; 270/58.17; 270/58.27

(58) Field of Classification Search ..... 270/58.07, 270/58.08, 58.11, 58.12, 58.17, 58.27, 58.1; 271/225, 228
See application file for complete search history.

(56) References Cited

U.S. PATENT DOCUMENTS

| | | | | |
|---|---|---|---|---|
| 6,264,194 | B1 * | 7/2001 | Hayashi et al. | 271/220 |
| 6,427,997 | B1 * | 8/2002 | Hirota et al. | 270/58.12 |
| 7,165,764 | B2 * | 1/2007 | Nakamura et al. | 270/58.11 |
| 7,306,214 | B2 * | 12/2007 | Iida et al. | 270/58.11 |
| 7,510,177 | B2 * | 3/2009 | Nagata et al. | 270/58.08 |
| 7,762,539 | B2 * | 7/2010 | Nagata et al. | 270/58.08 |
| 2006/0202402 | A1 * | 9/2006 | Nagata et al. | 270/58.08 |
| 2009/0097875 | A1 * | 4/2009 | Nagata et al. | 399/92 |

FOREIGN PATENT DOCUMENTS

JP 2008-213971 9/2008

* cited by examiner

*Primary Examiner* — Leslie A Nicholson, III
(74) *Attorney, Agent, or Firm* — Manabu Kanesaka

(57) ABSTRACT

A sheet collecting apparatus has a sheet transport path for transporting a sheet, a tray device for bearing and storing sheets, a regulation stopper for regulating the sheet, a holding path to temporarily hold a sheet, an alignment roller to transport the sheet, and a control device for controlling transport of the sheet. The alignment roller adjusts a level of pressing force acting on the sheet transported onto the tray device. The control device has a first operation mode and a second operation mode. In the first operation mode, the alignment roller applies a transport force to the sheet by a predetermined pressing force after a rear end of the sheet is carried into the tray device, while in the second operation mode, changing the pressing force applied to the sheets from the alignment roller from a first pressing force to a second pressing force and applying varied transport force.

7 Claims, 12 Drawing Sheets

SHEET COLLECTING APPARATUS, POST PROCESSING APPARATUS AND IMAGE FORMATION SYSTEM

BACKGROUND OF THE INVENTION

The present invention relates to a sheet collecting apparatus and collecting method of the apparatus for bearing and storing sheets carried out of a sheet discharge outlet in a post-processing apparatus, an image formation apparatus, etc. and more particularly, to improvements in an aligning mechanism and aligning method for neatly positioning and storing sheets fed onto tray means.

Generally, this type of sheet collecting apparatus has widely been known as an apparatus for bearing and storing sheets fed to a sheet discharge outlet of an image formation apparatus, etc. For example, post-processing apparatuses are known which have a post-processing unit for temporarily bearing sheets from the sheet discharge outlet to collate for each set, and performing post-processing such as binding processing, folding processing and punching processing on a bunch of sheets, and collect sheets with images formed for each set to perform bookbinding stapling, punching filing holes and the like.

When such an apparatus performs post-processing such as binding processing on a bunch of sheets collected for each set on a processing tray, a subsequent sheet may be supplied to a carry-in entrance on the upstream side. For example, Japanese Laid-Open Patent Publication No. 2008-213971 [Patent Document 1] discloses in FIG. 2 a post-processing apparatus for collecting sheets with images formed in the image formation apparatus for each set on the processing tray to staple. Then, a subsequent sheet may be supplied from the image formation apparatus during the operation of performing post-processing such as binding processing on a bunch of sheets collected for each set on the processing tray. It is proposed in the publication that a sheet transport path is provided with a holding section for temporarily holding a sheet, and overlapping the held sheet and a subsequent sheet to concurrently carry out of the sheet discharge outlet.

As described above, when a sheet supplied continuously and a subsequent sheet held in the transport path are overlapped and fed to the processing tray, and aligned by causing the sheets to strike a regulation stopper, conventionally, the sheets overlapped in the transport path and a sheet that is not overlapped are designed to strike the stopper in the same transport mechanism in both of the cases. For example, in the apparatus of Patent Document 1 described above, when a sheet from the sheet discharge outlet is transported toward the regulation stopper by a forward/backward rotation roller on the tray, the transport force that the roller applies to the sheet is controlled under the same condition for sheets that are overlapped and a sheet that is not overlapped.

However, when a sheet and another subsequent sheet are overlapped in the transport path and aligned by striking the stopper, the following problem occurs. When sheets from the sheet discharge outlet 90 are loaded and stored on the tray 91 as shown in FIG. 12, an alignment roller 92 is disposed above the tray, and feeds the sheets toward a rear-end regulation stopper 93, and the sheets thereby strike the stopper and are aligned. At this point, the overlapped sheets are sometimes displaced to the front and back in the shape of scales, or in order for the pages to get out of order in prior and subsequent sheets, the sheets are sometimes made displaced to the front or back. At this point, a sheet end of a prior sheet strikes the stopper, and then, the sheet is sometimes curved and becomes deformed upward above the tray. In this case, a rear sheet that is doubly displaced rises above the tray, and a problem occurs that a sheet jam arises. Particularly, when a sheet-surface pressing guide 94 is disposed between the alignment roller 92 and the rear-end regulation stopper 93, such a problem occurs that the sheet does not enter inside the guide.

It is an object of the invention to provide a sheet collecting apparatus for enabling sheets to be aligned neatly in a predetermined position on a tray even when front ends of the sheets are displaced to the front and back in overlapping the prior sheet Sf and subsequent sheet Sr and carrying the sheets out of a sheet discharge outlet to feed onto the tray.

Further, it is another object of the invention to provide a sheet collecting apparatus enabling sheets to be collected always with stability by varying control operation of an alignment roller for providing the sheet with a transport force between the case of overlapping a sheet and another subsequent sheet in a path to feed onto the tray and the case of feeding a sheet without overlapping with another sheet.

BRIEF SUMMARY OF THE INVENTION

To attain the above-mentioned objects, the present invention adopts the following configuration. A sheet collecting apparatus according to the invention has a sheet transport path for transporting a sheet from a carry-in entrance to a predetermined sheet discharge outlet, a tray means for bearing and storing sheets from the sheet discharge outlet, a regulation stopper for regulating the sheet by an end edge of the sheet fed onto the tray means striking the stopper, a holding path provided in the sheet transport path to temporarily hold a sheet from the carry-in entrance so as to overlap with a subsequent sheet to carry out of the sheet discharge outlet, an alignment roller disposed above the tray means to transport the sheet fed from the sheet discharge outlet to the regulation stopper, and a control means for controlling transport of the sheet from the carry-in entrance to the regulation stopper.

The alignment roller is provided with a pressing force adjustment means for adjusting a level of pressing force acting on a sheet transported onto the tray means, and the control means is comprised of a first operation mode for transporting a sheet fed from the carry-in entrance to the regulation stopper without holding in the holding path, and a second operation mode for holding a sheet fed from the carry-in entrance in the holding path to overlap with a subsequent sheet, and feeding sheets to the regulation stopper, where in the first operation mode, the alignment roller applies a transport force to the sheet by a predetermined pressing force after the rear end of the sheet is carried into the tray means, and in the second operation mode, for a period during which rear ends of overlapped sheets are carried into the tray means and then reach the regulation stopper, the alignment roller changes the pressing force applied to the sheets from the alignment roller from a strong force to a weak force and thereby applies the stepwise varied transport force.

The alignment roller is coupled to a driving motor so as to move the sheet carried onto the tray means forward by a predetermined distance in the sheet discharge direction, and then, move the sheet backward in the opposite direction to the sheet discharge direction so that the sheet strikes the regulation stopper and is aligned.

The tray means has a sheet mount surface shorter than a length in the sheet discharge direction of a maximum size sheet that can be mounted on the tray, and on the sheet mount surface is disposed a driven roller opposed to the forward/backward rotation roller.

The regulation stopper is disposed to regulate a rear end edge in the sheet discharge direction of the sheet on the tray means, and the sheet mount surface of the tray means is inclined so as to lower the regulation stopper side gradually, and in cooperation with the transport force of the alignment roller, forces the sheet to strike the regulation stopper to align.

The alignment roller is supported by roller lifting/lowering means for supporting the alignment roller to be able to move up and down between an operating position in which the roller comes into contact with an uppermost sheet and a standby position in which the roller is withdrawn above the sheet with respect to the tray means, and the roller lifting/lowering means is provided with a driving means for lifting and lowering the alignment roller between the operating position and the standby position, and the pressing force adjustment means for reducing the pressing force applied to the uppermost sheet from the alignment roller.

A post-processing apparatus according to the invention has a sheet collecting apparatus for bearing and storing sheets from a sheet discharge outlet on tray means, a post-processing means disposed in the tray means to perform post-processing such as binding processing, folding processing and punching processing on a bunch of collected sheet, and a stack tray for storing the sheets subjected to the post-processing in the tray means, where the stack tray is disposed on the downstream side of the tray means so as to support a front end portion of the sheets supported at its rear end portion by the tray means.

An image formation system according to the invention is formed of an image formation apparatus for forming images on sheets sequentially, and a post-processing apparatus for collecting the sheets from the image formation apparatus on a collection tray to perform post-processing, where the post-processing apparatus has the above-mentioned configuration.

The invention is to vary the operation mode of the alignment roller disposed on the tray between the first and second modes in the case of overlapping a sheet and a subsequent sheet Sr in the path to transport and the case of transporting a sheet without overlapping, change the pressing force applied to the sheet from the alignment roller from the strong force to the weak force after the sheet rear ends are fed onto the tray in overlapping the sheet and subsequent sheet Sr to transport, and thus provide stepwise varied transport force, and therefore, has the following effects.

In overlapping a plurality of sheets in the shape of sales and causing the sheets to strike the regulation stopper to align, defects do not occur that the end portion of a single front sheet strikes the stopper, and then, is curved above the tray and becomes deformed, the curved deformation causes the end portion of a sheet following in double state to be raised upward and folded, and that a sheet jam occurs. In other words, in the invention, in causing a plurality of overlapped sheets to strike the stopper to align, since the transport force is varied stepwise from strong to weak in front of the stopper, the sheet carried onto the tray is fed toward the stopper by strong transport force, and the transport force is switched to the weak force immediately before the sheet strikes the stopper. Therefore, it does not occur that mutually overlapped sheets do not reach the stopper and are thus in non-reach state, and that one of the sheets is curved and leads the other sheet to alignment failure such as a jam, front-end folding, etc.

Further, in the invention, the control of the alignment roller enables sheets to be neatly collected in a predetermined position on the tray in both of the cases that overlapped sheets are carried out, and that the sheet is carried out without overlapping, and thus, enables sheets to be always collected with stability.

BRIEF DESCRIPTION OF THE SEVERAL VIEWS OF THE DRAWINGS

FIG. 3 contains explanatory views of pressing force adjustment means in the apparatus of FIG. 2, where

FIG. 4 shows a configuration of a sheet pressing guide in the apparatus of FIG. 2, where

FIG. 5 shows a sheet discharge operation in the first mode in the apparatus of FIG. 2, where

FIG. 6 shows the sheet discharge operation in the first mode in the apparatus of FIG. 2, where

FIG. 7 shows a sheet discharge operation in the second mode in the apparatus of FIG. 2, where

FIG. 8 shows the sheet discharge operation in the second mode in the apparatus of FIG. 2, where

FIG. 9 shows the sheet discharge operation in the second mode in the apparatus of FIG. 2, where

DETAILED DESCRIPTION OF THE INVENTION

Figure 1:
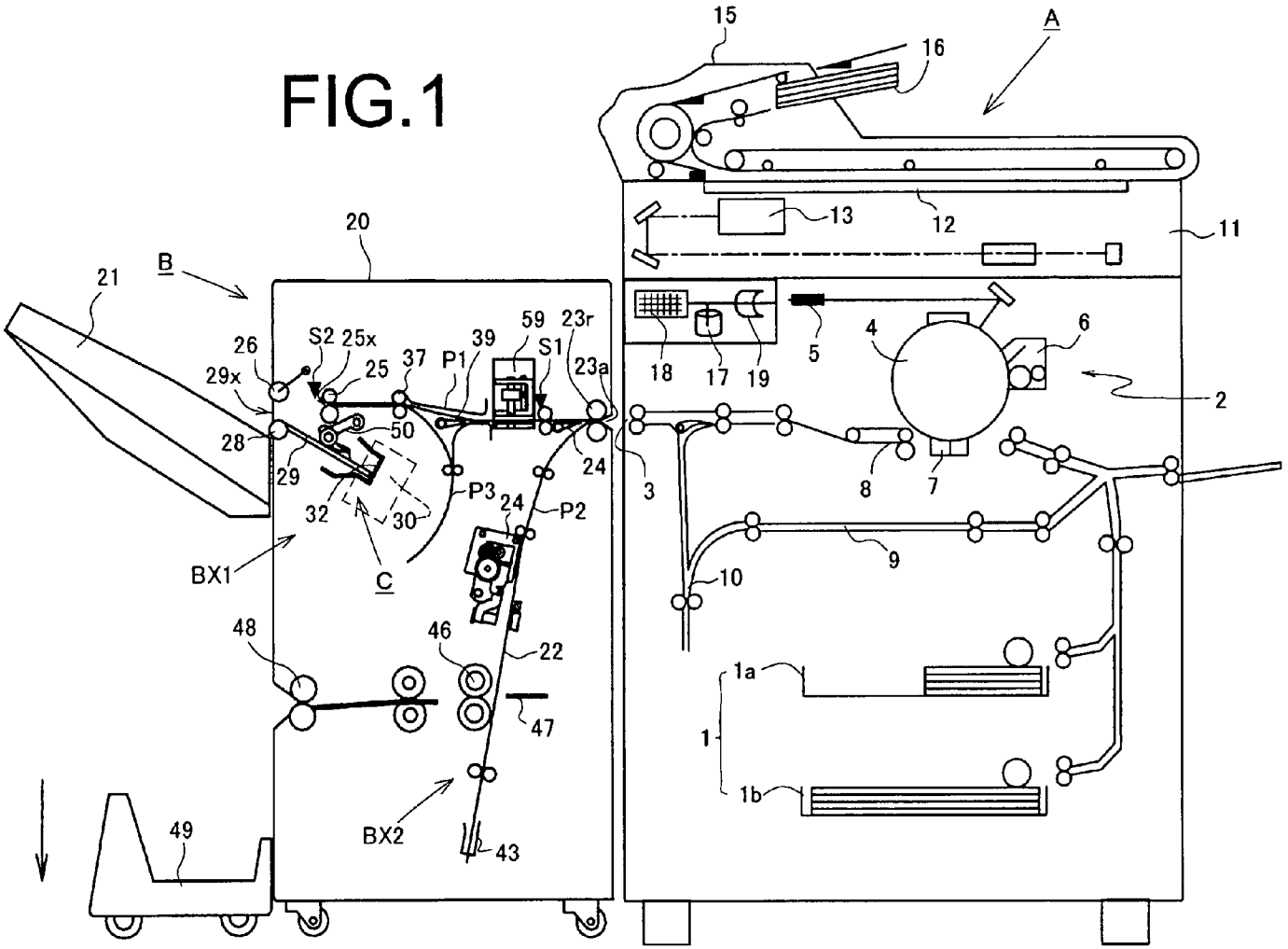
FIG. 1 is an explanatory view of an entire configuration of an image formation system according to the invention.
Figure 2:
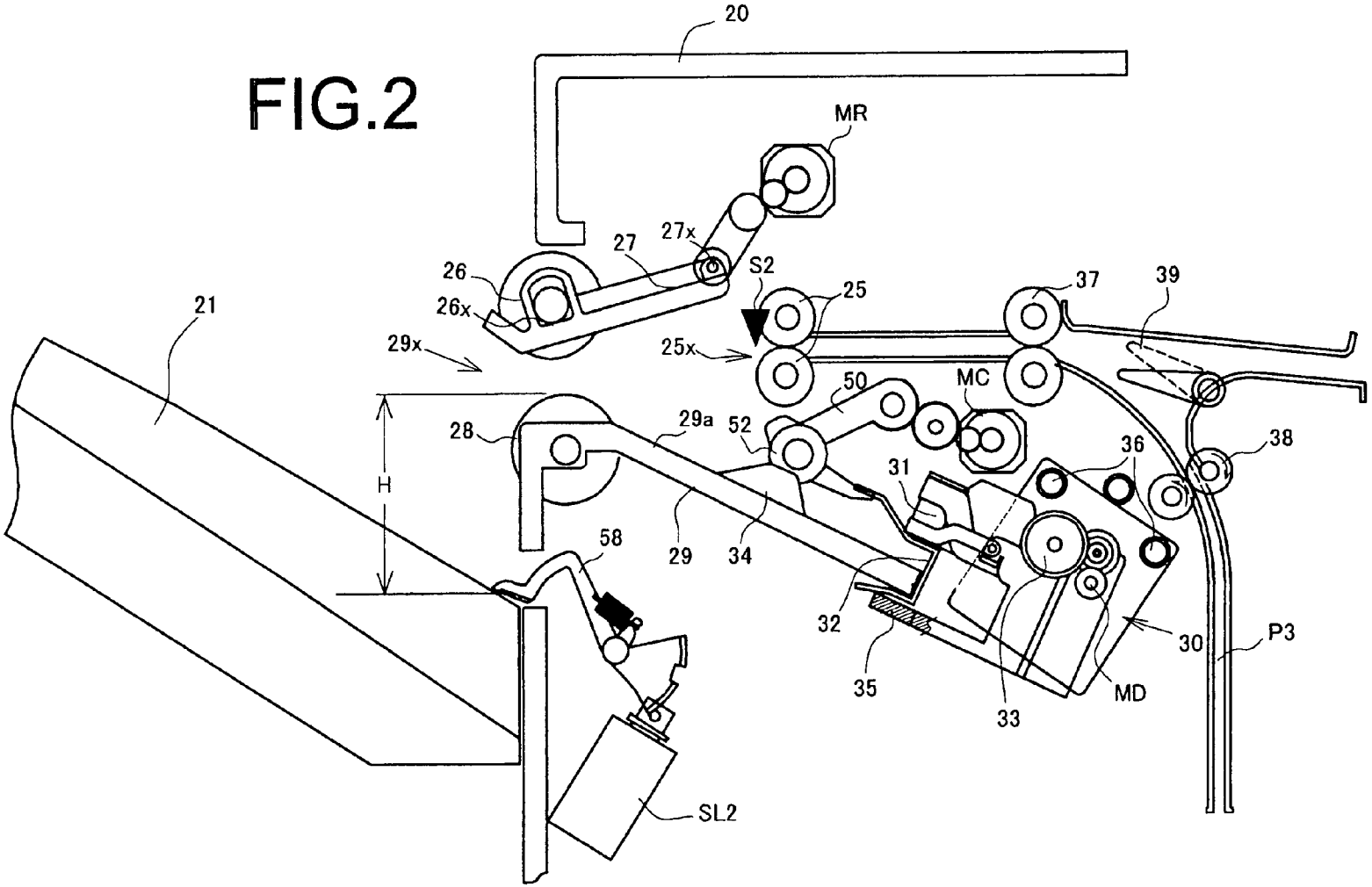
FIG. 2 shows a part of a post-processing apparatus in the system of FIG. 1 and is an explanatory view of a detailed structure of a sheet collecting apparatus (unit)

The present invention will specifically be described below based on preferred embodiments shown in drawings. FIG. 1 is an explanatory view of an entire configuration of an image formation system provided with a sheet collecting apparatus according to the invention, and FIG. 2 shows a part of a post-processing apparatus in the system of FIG. 1 and is an explanatory view of a detailed structure of the sheet collecting apparatus (unit).

[Image Formation System]

An image formation system as shown in FIG. 1 is formed of an image formation apparatus A and post-processing apparatus B, and a sheet collecting apparatus C is built into the post-processing apparatus B as a sheet collecting unit. Then, a carry-in entrance 23*a* of the post-processing apparatus B is coupled to a sheet discharge outlet 3 of the image formation apparatus A, and it is configured that sheets with images formed thereon in the image formation apparatus A are stapled in the post-processing apparatus B and stored in a stack tray 21 and second stack tray 49. The sheet collecting unit C is built into the post-processing apparatus B as a unit for collecting the image-formed sheets supplied to the carry-in entrance 23*a* in bunch form for each set. Each apparatus configuration will be described below.

[Image Formation Apparatus]

As shown in FIG. 1, the image formation apparatus A is configured so that a sheet is fed to an image formation section 2 from a sheet feeding section 1, printed in the image formation section 2, and discharged from a sheet discharge outlet 3. In the sheet feeding section 1, sheets with different sizes are stored in paper cassettes 1*a* and 1*b*, and designated sheets are separated on a sheet basis and fed to the image formation section 2. In the image formation section 2 are arranged, for example, an electrostatic drum 4, and a print head (laser emitter) 5, developer 6, transfer charger 7 and fuser 8 disposed around the drum, an electrostatic latent image is formed on the electrostatic drum 4 with the laser emitter 5, the developer 6 adds toner to the image, and the image is transferred onto the sheet with the transfer charger 7, and heated and fused with the fuser 8. The sheet with the image thus formed is sequentially carried out from the sheet discharge outlet 3. Reference numeral 9 shown in the figure denotes a circulating path, and is a path for two-side printing for reversing the side of the sheet with printing on its front side from the fuser 8 via a switch-back path 10, and feeding the sheet again to the image formation section 2 so as to print on the back side of the sheet. The side of the two-side printed sheet is reversed in the switch-back path 10, and the sheet is carried out from the sheet discharge outlet 3.

Reference numeral 11 shown in the figure denotes an image reading apparatus, where an original document sheet set on a platen 12 is scanned with a scan unit 13, and electrically read with a photoelectric conversion element not shown. The image data is subjected to, for example, digital processing in an image processing section, and then transferred to a data storing section (not shown), and an image signal is sent to the laser emitter 5. Further, reference numeral 15 shown in the figure is an original document feeding apparatus, and is a feeder apparatus for feeding an original document sheet stored in a paper tray 16 to the platen 12.

The image formation apparatus A with the above-mentioned configuration is provided with a control section (controller) 60 as shown in FIG. 8, and is set for image formation/printing conditions such as, for example, sheet size designation, color/monochrome printing designation, number-of-printed sheet designation, one-side/two-side printing designation, scaling printing designation and the like from a control panel 18. Meanwhile, it is configured in the image formation apparatus A that image data read by the scan unit 13 or image data transferred from an external network is stored in a data storing section 17, the image data is transferred to a buffer memory (page memory, etc.) 19 from the data storing section 17, and that a data signal is sequentially output to the laser emitter 5 from the buffer memory 19.

A post-processing condition is also input and designated from the control panel 18, concurrently with the image formation conditions such as one-side/two-side printing, scaling printing, monochrome/color printing and the like. Selected as the post-processing condition is, for example, a "print-out mode", "binding finish mode", "brochure finish mode" or the like.

[Configuration of the Post-Processing Apparatus]

The post-processing apparatus B is configured as described below to receive a sheet with the image formed thereon from the sheet discharge outlet 3 of the image formation apparatus A, and to (i) store the sheet in the stack tray 21 ("print-out mode"), (ii) collect sheets from the sheet discharge outlet 3 in the shape of a bunch for each set to staple, and store in the stack tray 21 ("binding finish mode"), or (iii) collect sheets from the sheet discharge outlet 3 in the shape of a bunch for each set, staple its center, fold in the shape of a brochure and store in the saddle tray 49 ("brochure finish mode").

A casing (exterior cover) 20 of the post-processing apparatus B is provided with the carry-in entrance 23*a*, and the carry-in entrance 23*a* is coupled to the sheet discharge outlet 3 of the image formation apparatus A. In the casing 20 are provided a first processing section BX1 that collects sheets from the carry-in entrance 23*a* for each set to perform a binding finish, and a second processing section BX2 that collects sheets from the carry-in entrance 23*a* for each set to perform a brochure finish. A first carry-in path P1 is provided between the first processing section BX1 and the carry-in entrance 23*a*, and a second carry-in path P2 is provided between the second processing section BX2 and the carry-in entrance 23*a*, so that the sheet from the carry-in entrance 23*a* is distributed and guided to the first processing section BX1 or the second processing section BX2. Further, the carry-in entrance 23*a* is provided with a carry-in roller 23*r*, sheet sensor S1, and path switching means (flapper member) 24 that distributes the sheet to the first or second carry-in path P1 or P2.

The first carry-in path P1 is disposed substantially in the horizontal direction in the upper portion of the apparatus housing formed of the casing 20, the first processing section BX 1 is disposed on the downstream side of the first carry-in path P1, and the stack tray 21 is disposed on the downstream side of BX1. Meanwhile, the second carry-in path P2 is disposed substantially in the vertical direction in the lower portion of the casing 20, the second processing section BX2 is disposed on the downstream side of the second carry-in path P2, and a collection guide 22 is disposed on the downstream side of BX2.

[Configuration of a Holding Path]

In the first carry-in path P1 as shown in FIG. 1, a holding path P3 is provided between a punch unit 59 and the processing tray 29. The holding path P3 is branched from the first carry-in path P1 to temporarily hold a sheet which is carried into the carry-in path, and is provided with a path switching flapper (path switching means) 39 for overlapping the sheet with a subsequent sheet Sr subsequently carried into the first carry-in path P1 to guide to the processing tray 29. Accordingly, a sheet entering from the carry-in entrance 23*a* is passed through the punch unit 59, is switched back and guided to the holding path P3 by the path switching flapper 39, and is temporarily held in the holding path P3.

Then, a control means (sheet transport control section 66*a* described later) for controlling a transport roller 37 of the first carry-in path P1 rotates the transport roller 37 forward (clockwise direction in FIG. 2) to transport a sheet from the carry-in entrance 23*a* to the processing tray 29 side. Then, in a stage where the sheet rear end is passed through the path switching flapper 39, the control means shifts the path switching flapper 39 to the dashed-line state as shown in FIG. 2. Concurrently therewith, the control means rotates the transport roller 37 in the reverse direction (counterclockwise direction in FIG. 2). Then, the sheet is switched back and transported to the holding path P3, and held inside the holding path by a roller 38.

The reason why the holding path P3 is provided branching from the first carry-in path P1 is to hold a sheet fed to the first carry-in path P1 in the holding path in performing the binding processing and other processing, in the processing tray 29, on sheets with images formed successively at predetermined intervals in the image formation apparatus A located on the upstream side.

Accordingly, the embodiment shown in the figure shows the case that the holding path P3 is branched from the first carry-in path P1 and formed, and it is also possible to provide a holding section in the first carry-in path to temporarily hold the sheet in the holding section.

The sheet transport control section 66*a* temporarily holds a sheet in the holding path P3, and when a subsequently fed sheet (hereinafter, referred to as "subsequent sheet Sr") is supplied to the carry-in entrance 23*a*, shifts the path switching means 39 to a solid-line position in FIG. 2 to transport the subsequent sheet Sr toward a sheet discharge roller 25. Then, when the sheet front end reaches the sheet discharge roller 25, the section 66*a* halts the sheet in this state. Then, the sheet transport control section 66*a* rotates the roller 38 in the direction shown by the arrow in FIG. 2, and transports the prior sheet Sf in the holding path P3 toward the sheet discharge roller 25. By this operation, the prior sheet Sf is overlapped with the subsequent sheet Sr and concurrently transported from the sheet discharge outlet 25*x* to the processing tray 29.

In other words, during the operation for performing post-processing on a bunch of sheets collated earlier in the processing tray 29, a sheet sent from the image formation apparatus A during the time is temporarily held in the holding path P3. Then, after the post-processing is completed in the processing tray 29, when the subsequent sheet Sr is supplied to the carry-in entrance 23*a*, the sheet transport control section 66*a* transports the subsequent sheet Sr to the sheet discharge outlet 25*x*, and halts the sheet discharge roller 25 in this state. Then, the section 66*a* drives and rotates the roller 38 in the holding path P3 to feed the prior sheet Sf to the sheet discharge roller 25*x*. Then, at the predicted time that the prior sheet Sf reaches the sheet discharge roller 25, the section 66*a* rotates the sheet discharge roller 25 in the sheet discharge direction. Upon the rotation, the subsequent sheet Sr is stacked on the prior sheet Sf, and both sheets are thus overlapped and transported from the sheet discharge outlet 25*x* onto the processing tray 29.

When the sheets transported as described above are stacked with the prior sheet Sf on the lower side and the subsequent sheet Sr on the upper side, the sheets are collected without pages getting out of order. Concurrently therewith, when front and rear end edges of both of the sheets are aligned in predetermined positions, the sheets are stacked on the processing tray in the normal attitude. At this point, when a sheet or sheets are transported from the sheet discharge outlet 25*x* to a predetermined position (rear-end regulation stopper 32 described later) in the processing tray 29, the same transport control has conventionally been adopted in both the case of transporting a single sheet from the sheet discharge outlet 25*x* and the case of transporting a plurality of stacked sheets. The invention is characterized in that the operation mode (first operation mode described later) for transporting a single sheet from the sheet discharge outlet 25*x* is different from the operation mode (second operation mode described later) for transporting a plurality of sheets. The configuration for the feature will be described below.

[Configuration of the First Processing Section]

Described first is a configuration of the first processing section BX1 as described above. The first processing section BX1 collects sheets from the first carry-in path P1 for each set, and performs post-processing on a bunch of sheets to store on the stack tray 21. Therefore, a level difference is formed in the sheet discharge outlet 25*x* of the first carry-in path P1 to provide the processing tray (tray means; which is the same in the following description) 29, and the stack tray 21 is disposed on the downstream side of the processing tray 29 (see FIG. 2).

The sheet discharge roller 25 and sheet discharge sensor S2 are disposed in the sheet discharge outlet 25*x* of the first carry-in path P1. The sheet discharge sensor S2 is provided to detect a sheet passed through the first carry-in path P1 so as to detect a jam and count the number of passed sheets. The processing tray 29 is formed of a synthetic resin plate or the like, and forms a sheet mount surface (tray surface) 29*a* for bearing and supporting sheets.

The sheet mount surface 29*a* is formed in dimensions longer than the length in the sheet discharge direction of the maximum sheet that can be stored to mount and support the entire length of the sheet from the sheet discharge outlet 25*x*, or is configured in dimensions shorter than the length in the sheet discharge direction of the maximum sheet that can be stored as shown in the figure. The apparatus as shown in the figure is characterized in that a sheet from the sheet discharge outlet 25*x* is supported in the shape of a bridge with its front end portion in the sheet discharge direction by the stack tray 21 and its rear end portion by the processing tray 29. By this bridge support structure, it is intended to make the apparatus small-size and compact.

[Configuration of the Alignment Roller]

In the processing tray 29 configured as described above are disposed an alignment roller 26 (forward/backward rotation roller in the figure; which is the same in the following description) for conveying the sheet sent from the sheet discharge outlet 25*x* to a predetermined position of the sheet mount surface 29*a* and rear-end regulation stopper 32. The alignment roller 26 is disposed above the processing tray 29 to be able to move up and down between an operating position (state in FIG. 2) for coming into contact with the sheet mount surface 29*a* and a standby position (state in FIG. 1) for separating upward from the sheet mount surface 29*a*. Therefore, the alignment roller 26 is supported by a lifting/lowering arm 27 supported by a support shaft 27*x* in the apparatus frame. Then, the alignment roller 26 is coupled to a forward/backward rotation motor not shown, and by this motor, is driven to rotate in the clockwise direction (sheet discharge direction) and the counterclockwise direction (opposite to the sheet discharge direction) as viewed in FIG. 3A. Concurrently therewith, the alignment roller 26 moves up and down between the operating position and the standby position by a shift motor MR (that can be a solenoid) coupled to the support shaft 27*x* of the lifting/lowering arm 27. In other words, a pulley is wound around the support shaft 27*x* of the lifting/lowering arm 27, and coupled to the shift motor MR via a transmission mechanism 27*m* such as a timing belt, gear, etc. The shift motor MR is formed of a forward/backward rotation motor, and lifts the lifting/lowering arm 27 by rotation in one direction, while lowering the arm 27 by rotation in the opposite direction.

Figure 3A:
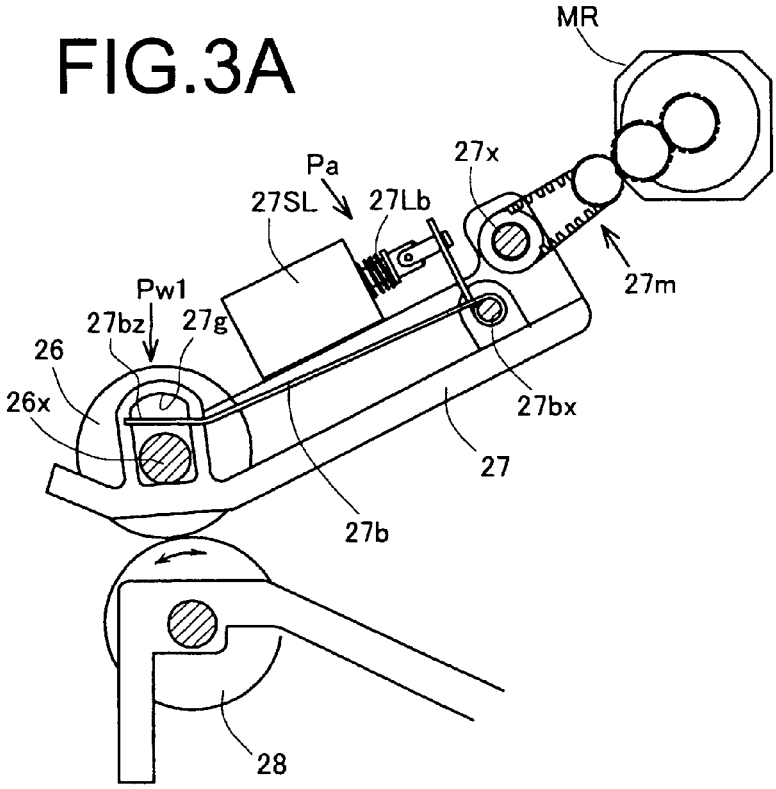
FIG. 3A is a state view when the pressing force of an alignment roller on a sheet is "weak"
Figure 3B:
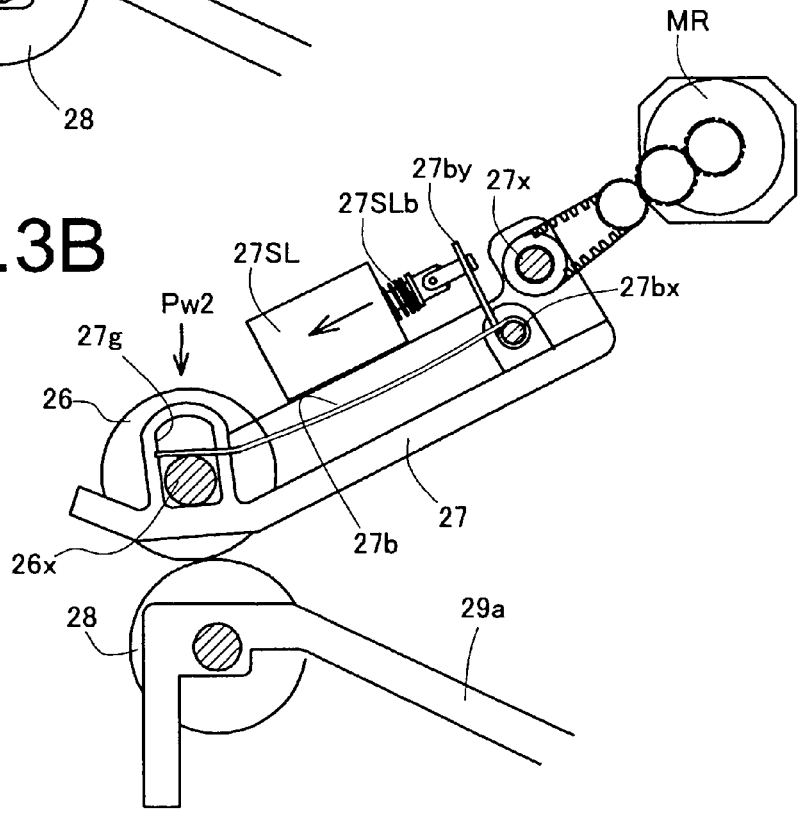
FIG. 3B is a state view where the pressing force is "strong"

The alignment roller 26 is provided with pressing force adjustment means Pa for adjusting the level of the pressing force (engagement force) applied to the uppermost sheet Su on the sheet mount surface 29*a*. The pressing force adjustment means Pa is shown in FIGS. 3A and 3B. In the alignment roller 26, a rotary shaft 26*x* is fitted with a long hole 27*g* formed in the lifting/lowering arm 27 and supported. By this support structure, the alignment roller 26 presses the uppermost sheet Su on the sheet mount surface 29*a* under its own weight (pressing force Pw1). The pressing force Pw1 is kept constant irrespective of the load amount of sheets by the action of the long hole 27*g*.

The lifting/lowering arm 27 is provided with a pressing spring (plate spring in the FIG. 27*b* to act on the alignment roller 26. The pressing spring 27*b* shown in the figure is a plate spring, and is supported at its base end portion 27*by* a support shaft 27*bx* to be rotatable. A front end portion 27*bz* of the pressing spring extends from the support shaft 27*bx* to press the rotary shaft 26*x* of the alignment roller 26 downward. Then, the base end portion 27*by* of the pressing spring is coupled to an operating solenoid 27SL. The operating solenoid 27SL is provided with a return spring 27SLb, and in a non-activated state, as shown in FIG. 3A, the pressing spring 27*b* is in a non-pressing state by the return spring 27SLb where the front end portion 27*bz* floats above the rotary shaft 26*x* of the alignment roller 26. Further, in an activated state of the operating solenoid 27SL, as shown in FIG. 3B, the pressing spring 27*b* is curved and becomes deformed, and is configured that the front end portion 27*bz* presses (pressing force Pw2) the rotary shaft 26*x* of the alignment roller 26.

Accordingly, in the non-activated state of the operating solenoid 27SL, the pressing spring 27*b* is in the state in FIG. 3A, and the alignment roller 26 exerts the pressing force Pw1 on the uppermost sheet Su on the processing tray under its own weight. Meanwhile, when the operating solenoid 27SL is activated, the pressing spring 27*b* is in the state in FIG. 3B, and the alignment roller 26 exerts the pressing force Pw2 ("weight of the roller 26"+"spring pressure") on the uppermost sheet Su. Then, the pressing force is set at Pw1>Pw2.

Meanwhile, in the sheet mount surface 29*a* of the processing tray 29 is disposed a driven roller 28 in a position opposed to the alignment roller 26. The driven roller 28 is provided to reduce resistance when a sheet enters the processing sheet 29 or a processed sheet bunch on the processing tray is transferred to the stack tray 21.

The rear-end regulation stopper 32 is disposed in the rear end portion (upstream side in the sheet discharge direction) of the processing tray 29. The rear-end regulation stopper 32 is formed of a regulation member having a stopper surface which the rear end edge of the sheet strikes to be regulated. Then, the sheet entering onto the processing tray is switched back by the alignment roller (forward/backward rotation roller) 26 so that the rear end of the sheet is regulated by striking. Side aligning plates 34 are disposed in the processing tray 29. The aligning plates 34 position and align the side end edges of the sheet on the processing tray 29 in a beforehand set reference (side reference or center reference). Although a structure of the plates is not described specifically, for example, a pair of aligning plates are provided in opposite end portions on the processing tray, and when the right and left aligning plates are moved in opposite directions in synchronization with each other to close and separate, side alignment is made with reference to the sheet center. Meanwhile, when one of the right and left aligning plates is fixed and the other plate closes and separates from the fixed alignment plate, side alignment is made with reference to the side.

Described next is the post-processing means (stapling unit) 30 disposed in the processing tray 29. The post-processing means 30 as shown in FIG. 2 is formed of a stapling unit for binding a bunch of sheets collected on the tray. The stapling unit 30 is formed of a driver 31 and clincher 35. The driver 31 is formed of a head member that inserts a staple into a bunch of sheets set in a binding position, cartridge for storing staples, driver cam 33, and staple motor MD for driving the driver cam 33. The clincher 35 is disposed in a position opposed to the driver 31 with a bunch of sheets therebetween, and formed of a bend groove to bend the front end of the staple inserted into the bunch of sheets.

The post-processing means (stapling unit) 30 is supported by a guide rod 36 in the apparatus frame to be able to move to positions in the sheet width direction, and is configured to move to positions by a control motor not show. By this means, using a single stapling unit (post-processing means) 30, it is possible to staple two right and left portions in the sheet side edge, or a sheet corner.

A sheet pressing guide 50 is disposed between the rear-end regulation stopper 32 and alignment roller 26. The sheet pressing guide 50 is to press from above the rear end edge of the sheet which is switch-backed and transported to the rear-end regulation stopper 32 so as to prevent the rear end edge from curving upward and rising. In other words, when the alignment roller 26 forces the sheet rear end to strike the rear-end regulation stopper 32 to regulate, a curled sheet or a soft sheet is sometimes curved upward and raised above the stopper. Therefore, the guide member is required to press the sheet end portion forced to strike the rear-end regulation stopper 32 from above.

[Sheet Pressing Guide]

Figure 4A:
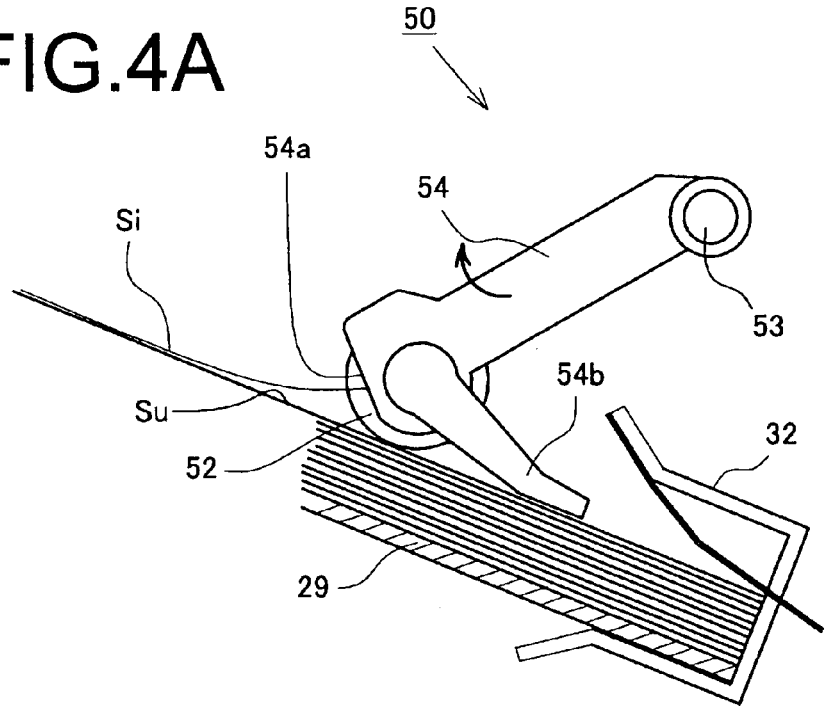
FIGS. 4A and 4B show different embodiments.

An embodiment (first embodiment) of the sheet pressing guide (guide member) 50 will be described based on FIG. 4A. The guide member 50 is formed of a roller member or plate member for pressing the uppermost sheet Su on the processing tray 29. FIG. 4A shows the case of pressing the uppermost sheet Su on the processing tray by a roller member. A shaking arm 54 is supported by a support shaft 53 in the apparatus frame, and a guide roller is axially supported by the shaking arm 54 to be rotatable. Then, the guide roller 52 is provided on its front end side with a guide piece 54*b* for guiding the sheet rear end portion fed toward the rear-end regulation stopper 32, and is provided on its rear end side with a carry-in guide 54*a* for guiding the sheet to between the roller and the uppermost sheet, where the guide 54*a* is integrally formed in the shaking arm 54.

Figure 4B:
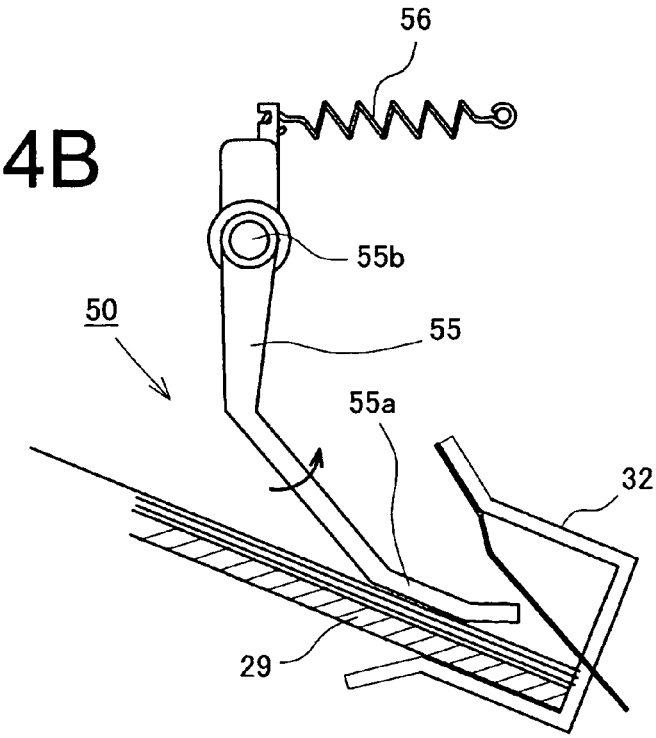

A second embodiment of the sheet pressing guide 50 will be described next based on FIG. 4B. FIG. 4B shows the case that the pressing guide is formed of a plate-shaped member. A support shaft 55*b* is provided in the apparatus frame, and a plate-shaped guide member 55 is attached to the support shaft 55*b* to be shakable. Then, the front end portion of the plate-shaped guide member 55 is integrally provided with a sheet pressing piece 55*a* for pressing the uppermost sheet Su on the processing tray from above. In such a configuration, the sheet pressing piece 55*a* always presses the uppermost sheet Su on the processing tray 29 by a predetermined pressure.

The processing tray 29 is provided with a sheet-bunch carrying-out means (not shown) for carrying out the processed sheet bunch to the stack tray 21 on the downstream side. The sheet-bunch carrying-out means is disposed at the bottom of the processing tray 29, and is formed of a sheet engagement member (grip member) for protruding above the sheet mount surface 20*a* to engage in a sheet bunch, and a carrier member such as a belt for moving the sheet engagement member from the right end to the left end as viewed in FIG. 2 along the processing tray 29. The sheet bunch subjected to the post-processing such as stapling in the processing tray 29 is carried out of a sheet discharge outlet 29*x* of the processing tray 29 to the stack tray 21.

[Configuration of the Second Processing Section]

The second processing section BX2 is formed of the collection guide 22 disposed in the second carry-in path P2, and a saddle-stitching stapling unit 40 and folding processing mechanism 44 disposed in the collection guide 22. The collection guide 22 disposed on the downstream side of the second carry-in path P2 is configured to bear and store sheets from the carry-in entrance 23*a* in the upright position. The collection guide 22 is in the shape of being curved in the center, and is formed in the shape with the length for accommodating the maximum-size sheet therein. In the collection guide 22 are disposed the saddle-stitching stapling unit 40 and folding processing mechanism 44.

Further, the front end portion of the guide is provided with a front end stopper 43 for regulating the sheet front end, and is disposed to be able to move to positions corresponding to the sheet size (length in the sheet discharge direction).

The saddle-stitching stapling unit 40 has substantially the same configuration as that of the end-binding stapling unit 30 as described previously, and descriptions thereof are omitted. In this unit, the driver mechanism and clincher mechanism are separate and thus formed so that a sheet bunch to staple is passed through the center. The other configuration is the same as in the unit described previously.

The folding processing mechanism 44 is formed of a fold roll means 46 for folding a bunch of sheets collated for each set in the collocation guide 22, and a fold blade 47 for inserting the bunch of sheets into a nip position of the fold roll means 46. The fold roll means 46 is comprised of a pair of rolls formed of material with a relatively high coefficient of friction such as a rubber roller and the like. Further, the fold blade 47 is able to reciprocate in the orthogonal direction to the collection guide 22 to insert a fold position of the sheet bunch into the nip position of the fold roll means 46, and is coupled to an actuating means (motor, solenoid, etc.) not shown. Reference numeral 48 shown in the figure is a sheet discharge roller, and carries out the sheet bunch folded in the fold roll means 46 to the saddle tray 49.

As described above, the processing tray 29 is provided with the alignment roller 26, rear-end regulation stopper 32 and sheet pressing guide 50. Then, the alignment roller 26 is disposed to transport a sheet carried onto the processing tray to the rear-end regulation stopper 32. Further, the rear-end regulation stopper 32 is situated in the end portion of the processing tray 29, and is configured that the rear end edge of the sheet strikes the stopper 32 and that the sheet is thereby aligned. Further, the sheet pressing guide 50 presses from above the rear end portion of the sheet fed to the rear-end regulation stopper 32, and is configured to prevent the rear end portion from rising.

Then, the invention provides the alignment roller 26, rear-end regulation stopper 32 and sheet pressing guide 50 with (first operation mode) where a single sheet is carried out of the sheet discharge outlet 25*x* and with (second operation mode) where a plurality of overlapped sheets is carried out of the sheet discharge outlet 25*x*. Then, in the first operation mode, after the rear end of the sheet is carried onto the processing tray (tray means) 29, the alignment roller 26 applies a transport force to the sheet by the predetermined pressing force Pw. In the second operation mode, after rear ends of the overlapped sheets are carried onto the processing tray (tray means) 29, the alignment roller 26 varies the pressing force Pw acting on the sheets from strong to weak, and applies the stepwise varied transport force for a period during which the rear ends reach the rear-end regulation stopper 32. These operation modes will be described below with respect to the "control configuration" and "operation mode" in this order.

[Explanation of the Control Configuration]

Figure 10:
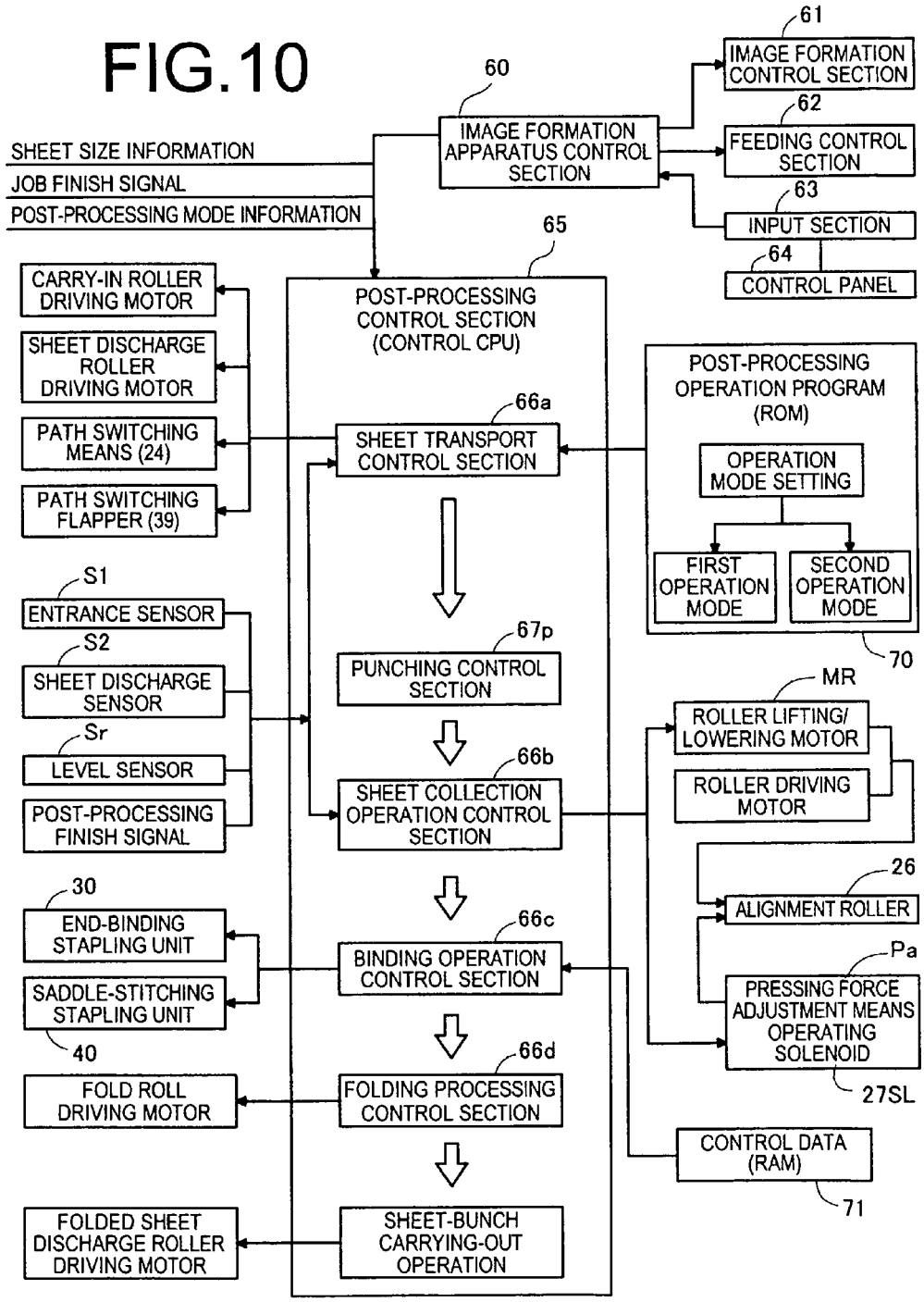
FIG. 10 is a block diagram illustrating a control configuration in the system of FIG. 1.

The control configuration of the image formation system as described above will be described below according to a block diagram of FIG. 10. The image formation system as shown in FIG. 1 is provided with a control section (hereinafter referred to as a "main body control section") 60 of the image formation apparatus A and a control section (hereafter referred to as a "post-processing control section") 65 of the post-processing apparatus B. The main body control section 60 is provided with an image formation control section 61, feeding control section 62 and input section 63. Then, the settings of "image formation mode" and "post-processing mode" are made from the control panel provided in the input section 63. As described previously, the image formation mode is to set image formation conditions such as the number of printout sets, sheet size, color/monochrome printing, scaling printing, one-side/two-side printing and others. Then, the main body control section 60 controls the image formation control section 61 and feeding control section 62 corresponding to the set image formation conditions, forms an image on a predetermined sheet, and then, sequentially carries out the sheet from the main-body sheet discharge outlet 3.

Concurrently therewith, the post-processing mode is set by input from the control panel 18. For example, the "print-out mode", "end binding finish mode", or "sheet-bunch folding finish mode" is set as the post-processing mode. Then, the main body control section 60 transfers the finish mode of post-processing, the number of sheets, information of the number of sets, and binding mode (one-portion binding, two-portion binding, or multiple-portion binding) information to the post-processing control section 65. Concurrently therewith, the main body control section 60 transfers a job finish signal to the post-processing control section 65 whenever image formation is completed.

In the invention, the "end binding finish mode" is set as the post-processing mode, sheets with images formed in the image formation apparatus A are collected on the processing tray 29 for each set, the stapling unit (post-processing means) 30 performs binding processing on the sheets on the processing tray, and the processed sheet bunch is stored on the stack tray 21. During this post-processing, a prior sheet Sf carried out of the image formation apparatus A is temporarily held in the holding path P3 as described previously. Then, at the timing a subsequent sheet Sr reaches the sheet discharge roller 25, the prior sheet Sf is fed from the holding path P3 to the sheet discharge roller 25, and overlapped under the subsequent sheet Sr. Then, the overlapped sheets are concurrently carried out of the sheet discharge outlet 25*x* and fed onto the processing tray. Therefore, the post-processing control section (control CPU 65) is configured as described below.

[Post-Processing Control Section]

The post-processing control section 65 is provided with the control CPU 65 for operating the post-processing apparatus B corresponding to the designated finish mode, ROM 70 for storing an operation program, and RAM 71 for storing control data. Then, the control CPU 65 is comprised of a "sheet transport control section 66*a*" for executing transport of a sheet fed to the carry-in entrance 23*a*, "punching control section 67*p*" for punching punched holes in a sheet from the image formation apparatus A, "sheet collection operation control section 66*b*" for controlling collection of sheets for each set to the processing tray 29, "binding operation control section 66*c*" for performing binding processing on a bunch of sheets collected on the processing tray 29, and "folding processing control section 66*d*" for performing folding processing on a bunch of sheets collected in the collection guide 22.

[Sheet Transport Control Section]

The sheet transport control section 66*a* is coupled to control circuits (driver circuits) of driving motors of the carry-in roller 23*r*, transport roller 37 and sheet discharge roller 25 of the first carry-in path P1, respectively. Further, the sheet transport control section 66*a* is coupled to the path switching means 24 and the operating solenoid (not shown) of the path switching flapper 39. The sheet transport control section 66*a* is connected to receive detection signals from the sheet sensor S1 and sheet discharge sensor S2.

The sheet transport control section 66*a* controls the path switching means 24 for a sheet from the carry-in entrance 23*a* corresponding to the post-processing mode. When the post-processing mode set in the image formation apparatus A is the "print-out mode" or "end binding finish mode", this control is configured to guide the sheet to the first carry-in path P1. This control is to drive the carry-in roller 23*r* and sheet discharge roller 25 to rotate in the sheet discharge direction by a sheet discharge designation signal from the image formation apparatus A, and operate the path switching means 24 to guide a sheet to the first carry-in path P1 based on a sheet detection signal from the sheet sensor S1. Meanwhile, when the "sheet-bunch folding finish mode" is selected as the post-processing mode, the path switching means 24 is operated to guide a sheet to the second carry-in path P2. Further, the section 66*a* controls the path switching flapper 39 to guide a sheet carried into the first carry-in path P1 to the holding path P3, for example, based on a job finish signal from the image formation apparatus A.

[Punching Control Section]

The punching control section 67*p* is configured to punch punched holes in a sheet guided to the first carry-in path P1 when the post-processing mode is set at "punching punched holes in the print-out mode" or "punching punched holes in the end binding finish mode".

[Sheet Collection Operation Control Section]

The sheet collection operation control section 66*b* is configured to control the alignment roller 26 when the post-processing mode is set at the "print-out mode" or "end binding finish mode". The sheet collection operation control section 66*b* is connected to a driving circuit of the shift motor MR provided in the alignment roller 26 to collect sheets on the processing tray 29, and to the operating solenoid 27SL of the pressing force adjustment means Pa.

Then, the section 66*b* moves the alignment roller from the standby position to the sheet engagement position by a detection signal from the sheet discharge sensor S2 disposed in the sheet discharge outlet 25*x* so as to transfer a sheet carried onto the processing tray 29 to the stack tray 21 side. Then, after a lapse of predicted time that the sheet rear end is carried onto the processing tray, the section 66*b* reverses rotation of the alignment roller 26 to feed the sheet to the rear-end regulation means 32 disposed in the processing tray 29. The control of the alignment roller 26 will be described later.

Further, the sheet collection operation control section 66*b* is coupled to a driving circuit of an operating motor (alignment operating motor; not shown) of the aligning plates 34 disposed on the processing tray 29. Then, it is configured that the width of the sheet fed by the alignment roller 26 is aligned by the aligning plates 34. Therefore, the sheet collection operation control means 66*b* causes the right and left aligning plates to reciprocate in the sheet width direction in a predetermined range corresponding to the sheet size.

[Binding Operation Control Section]

The binding operation control section 66*c* is configured to control the stapling means (end-binding stapling unit) 30, bunch carrying-out means (not shown) and lifting/lowering motor MS of the stack tray 21 when the post-processing mode is set at the "end binding finish mode".

[Explanation of the Operation]

Figure 11:
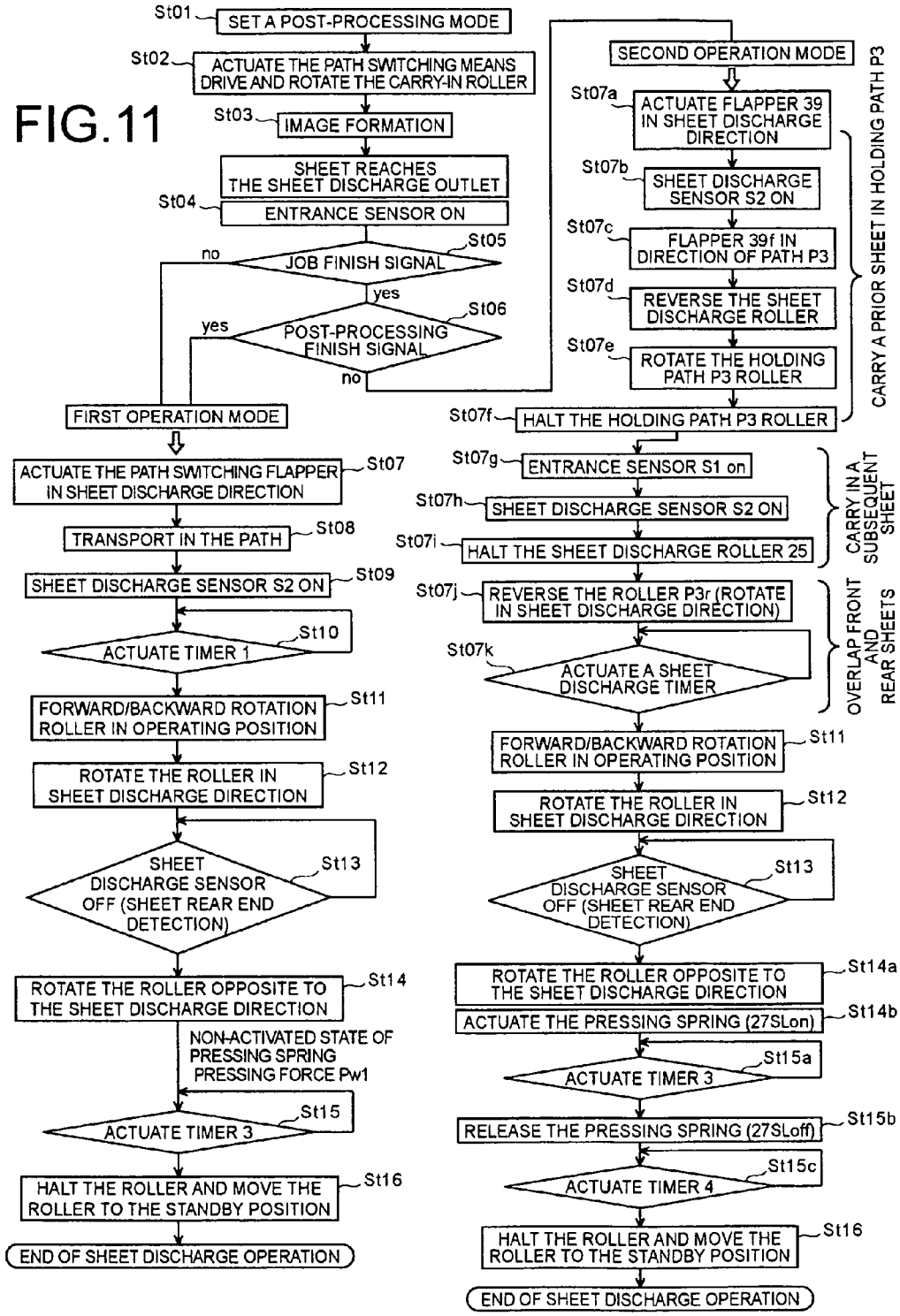
FIG. 11 is a flowchart illustrating the sheet discharge operation in the first and second modes in the apparatus of FIG. 2.
Figure 12:
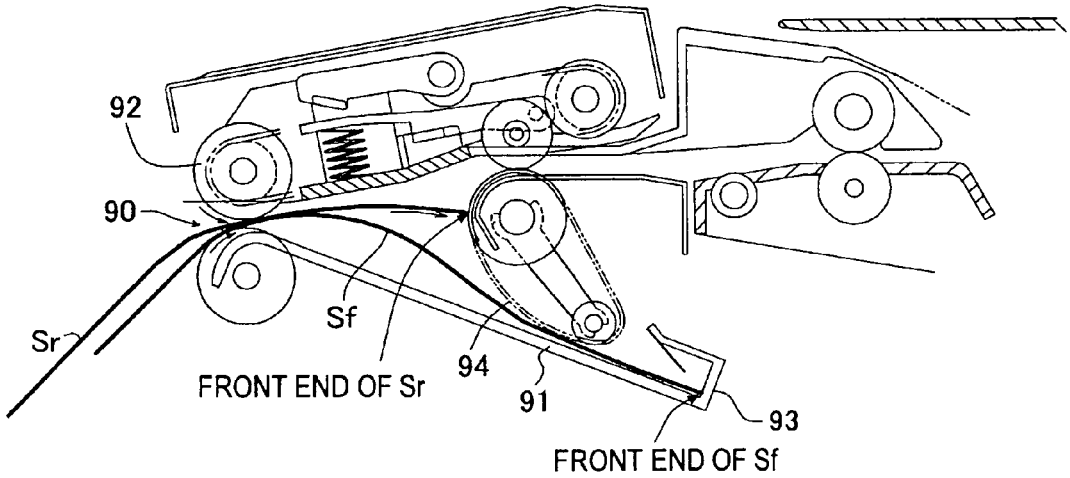
FIG. 12 is an explanatory view of conventional technique showing a sheet collected state in a conventional sheet collected structure.

Described next is the control operation executed by the control CPU 65. FIG. 11 is a flowchart illustrating the operation of the control CPU 65, and FIGS. 5 to 9 are explanatory views of operating states. The image formation apparatus A is started, and image formation conditions are set. Concurrently with the setting, the post-processing mode is set (St 01). Then, upon receiving the setting information of the post-processing mode from the image formation apparatus A, the control CPU 65 of the bookbinding apparatus B operates the path switching means 24 to guide sheets to the first or second carry-in path P1 or P2 corresponding to the post-processing mode (St 02). At this point, when the "print-out mode" or "end binding finish mode" is set as the post-processing mode, the path switching means 24 guides sheets to the first carry-in path P1. Meanwhile, when the "sheet-bunch folding finish mode" is set, the means 24 guides sheets to the second carry-in path P2. Further, concurrently with the path switching means 24, the control CPU 65 starts and rotates the carry-in roller 23*r*. By this means, sheets fed to the carry-in entrance 23*a* are guided to the first carry-in path P1 or second carry-in path P2.

The invention relates to the control of feeding sheets from the first carry-in path P1 to the processing tray 29 in the "end binding finish mode", and the operation in the "end binding finish mode" will be described below. When an image-formed (St 03) sheet is discharged from the sheet discharge outlet 3, the control CPU 65 detects the sheet front end by the sheet sensor S1 (St 04).

The control CPU 65 determines whether or not the image formation apparatus issues a job finish signal, in tandem with the sheet detection in the sheet sensor S1 (St 05). When this signal is not issued (determination "no"), the CPU 65 guides this sheet to the processing tray 29 according to the "first operation mode". Meanwhile, when the job finish signal is issued (determination "yes"), the CPU 65 determines whether a post-processing finish signal is issued from the post-processing means (for example, the stapling unit 30) (St 06). When this determination shows that the post-processing finish signal is issued (determination "yes"), the CPU 65 executes the first operation mode. Meanwhile, when a result of the determination shows "no", the CPU 65 shifts to the second operation mode.

Thus, when a sheet enters the first carry-in path P1, the control CPU 65 executes the first operation mode prior to the post-processing operation on the processing tray 29, or subsequent to post-processing operation end, while executing the second operation mode when determining that the post-processing operation is being executed on the processing tray 29.

[First Operation Mode]

When the control CPU 65 determines that the mode is the first operation mode in the above-mentioned determination, the control CPU 65 executes the following sheet discharge in the first operation mode. The control CPU 65 (the sheet transport control section 66*a*; which is the same in the following description) positions the path switching flapper 39, which is disposed in the intersection portion of the first carry-in path P1 and holding path P3, in the sheet discharge direction (solid-line state in FIG. 2) (St 07). Then, a sheet fed to the carry-in entrance 23*a* is guided to the sheet discharge outlet 25*x*, and the control CPU 65 drives the transport roller 37 to guide the sheet from the carry-in entrance 23*a* to the sheet discharge outlet 25*x* in the path (St 08).

Figure 5A:
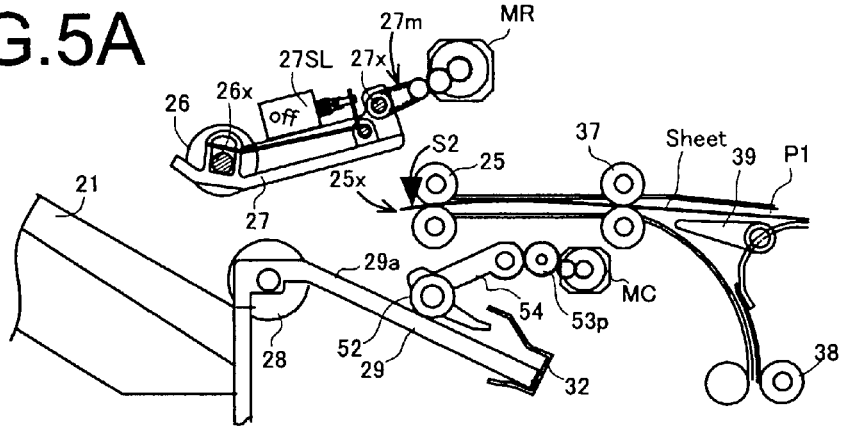
FIGS. 5A, 5B and 5C show a procedure of guiding a sheet front end onto a processing tray from a carry-in entrance.

Next, the sheet discharge sensor S2 disposed in the sheet discharge outlet 25*x* detects the front end of the sheet (St 09). A beforehand set timer 1 is actuated with reference to the signal (St 10). This timer 1 is set for the predicted time that the sheet front end reaches the alignment roller 26 on the processing tray. This state is shown in FIG. 5A, where the sheet front end is passed through the sheet discharge sensor S2, is carried out of the first carry-in path P1, and fed toward the alignment roller 26 (see FIG. 5A).

Figure 5B:
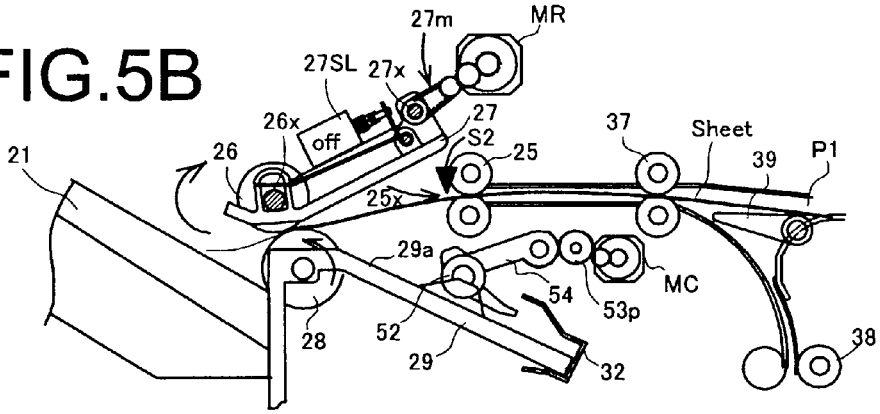

Next, after a lapse of the set time in the timer 1, the control CPU 65 moves the alignment roller 26 (downward) from the standby position to the operating position. For the backward operation, the control CPU 65 shakes the lifting/lowering arm 27 using the shift motor MR (St 11). Then, the control CPU 65 rotates the alignment roller 26 in the sheet discharge direction (in the clockwise direction in FIG. 2) (St 12). By the rotation of the alignment roller 26, the prior sheet Sf moves forward in the sheet discharge direction as shown in FIG. 5B.

Figure 5C:
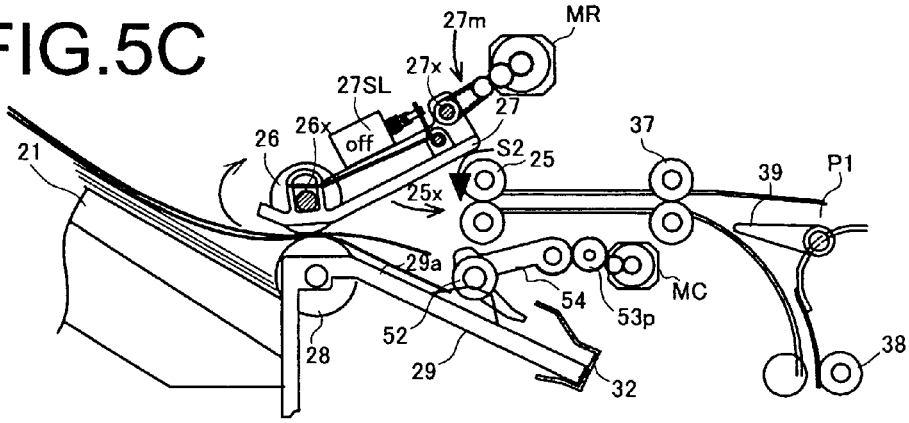
Figure 6A:
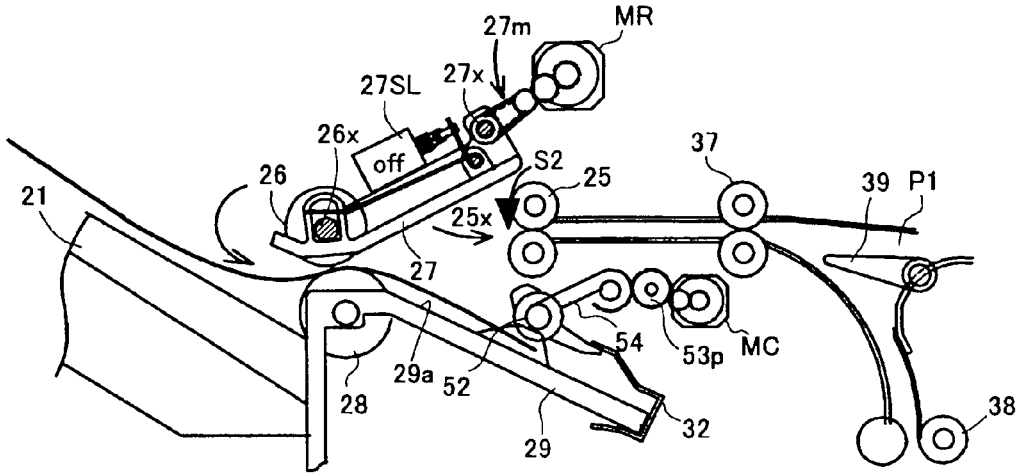
FIGS. 6A and 6B show a state where the sheet guided onto the processing is aligned by striking a regulation stopper.

Next, the control CPU 65 monitors whether or not the sheet rear end is passed through the sheet discharge sensor S1 (St 13). Then, the control CPU 65 halts the alignment roller 26 with reference to a detection signal (sensor OFF) from the sheet discharge sensor S2, and rotates the alignment roller 26 in the opposite direction to the sheet discharge direction (St 14). Concurrently with the backward rotation of the alignment roller 26, the control CPU 65 actuates a time 3 (St 15). This timer 3 is set for the predicted time that the sheet rear end reaches the rear-end regulation stopper 32. This state is shown in FIG. 5C. At this point, in the first operation mode, the control CPU 65 (sheet transport control section 66*a*) maintains the operating solenoid 27SL provided in the lifting/lowering arm 27 of the alignment roller 26 at the non-activated state. Accordingly, the alignment roller 26 presses the sheet carried onto the sheet mount surface 29*a* by the predetermined pressing force Pw1 (roller's weight in the embodiment shown in the figure). FIG. 6A shows the state where the sheet carried onto the processing tray is transported to the rear-end regulation stopper 32. At this point, the transport force applied to the sheet from the alignment roller 26 is [pressing force Pw1×(coefficient of friction ν between the sheet and roller)].

Figure 6B:
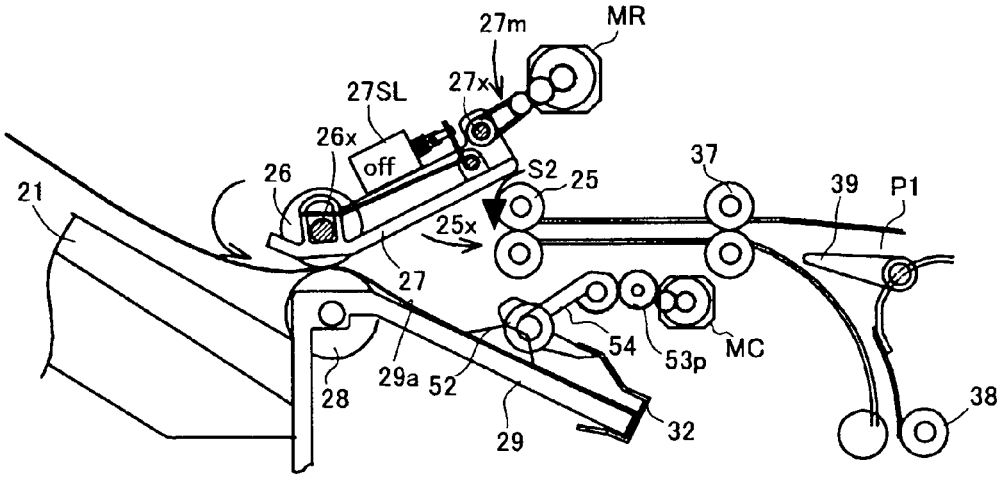

After a lapse of the set time of the timer 3, the control CPU 65 regards the sheet rear end as striking the rear-end regulation stopper 32 to be aligned, and halts the alignment roller 26. This state is shown in FIG. 6B, and the control CPU 65 halts the alignment roller 26 a slight delay time later after the sheet rear end strikes the rear-end regulation stopper 32. Then, the transport force applied to the sheet from the alignment roller 26 is set at the extent that the sheet rear end hit by the rear-end regulation stopper 32 does not fold. Then, the control CPU 65 shifts the alignment roller 26 from the operating position to the standby position (St 16). By repeating such an operation, sheets are transported from the carry-in entrance 23*a* to the processing tray 29 and collected on the processing tray 29.

[Second Operation Mode]

When the second operation mode is set by the operation mode setting means, the control CPU 65 executes the following sheet discharge operation. This sheet discharge operation will be described based on FIGS. 7 and 8, and the same operation as in the first operation mode is assigned the same reference numeral to omit descriptions thereof. The control CPU 65 (the sheet transport control section 66*a*; which is the same in the following description) positions the path switching flapper (hereinafter, referred to as a "flapper") 39, which is disposed in the intersection portion of the first carry-in path P1 and holding path P3, in the sheet discharge direction (solid-line state in FIG. 2) (St 07*a*). Then, a sheet fed to the carry-in entrance 23*a* is guided to the sheet discharge outlet 25*x*, and the control CPU 65 drives the transport roller 37 to transport the sheet from the carry-in entrance 23*a* to the sheet discharge outlet 25*x*. The sheet discharge sensor S2 detects the sheet front end (St 07*b*). The control CPU 65 shifts the flapper 39 to the dashed-line state in FIG. 2 after a delay time required for the sheet rear end to pass through the intersection portion of the first carry-in path P1 and the holding path P3 (St 07*c*). Subsequently, the control CPU 65 rotates backward the sheet discharge roller 25 and the roller 38 of the holding path P3 in the opposite direction to the sheet discharge direction (St 07*d*, St 07*e*).

Figure 7A:
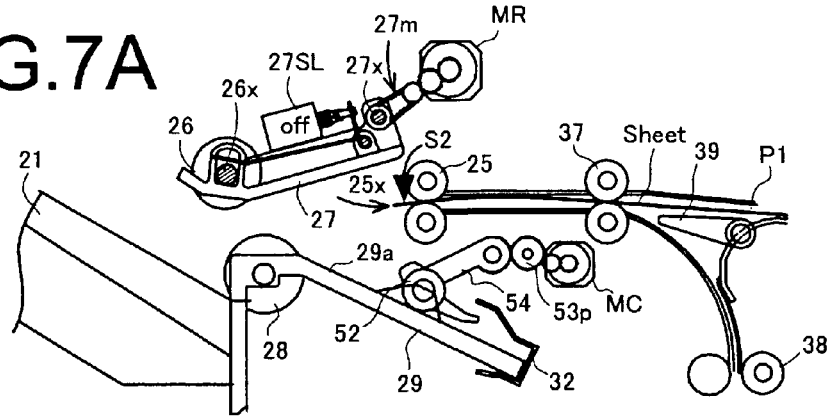
FIGS. 7A, 7B and 7C show a procedure of guiding a sheet to a holding path from the carry-in entrance.

FIG. 7A shows the state where the sheet is sent to the sheet discharge outlet 25*x* and the sheet rear end passes through the path intersection portion, and at this point, the control CPU 65 halts the sheet discharge roller 25 and switches the flapper 39 to the dashed-line state in FIG. 2.

Figure 7B:
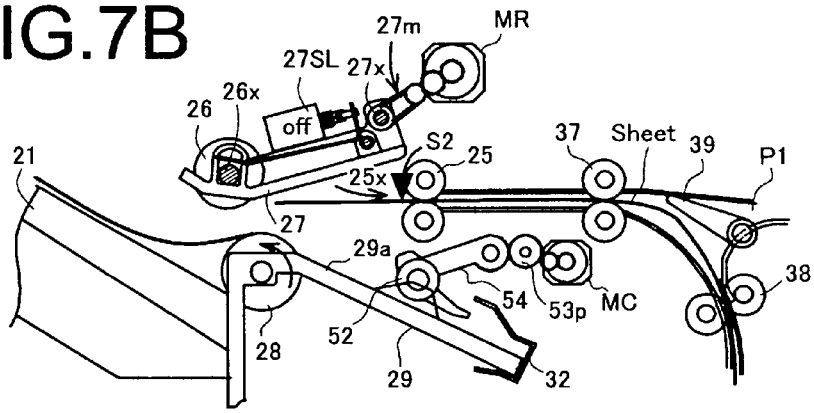

Then, the control CPU 65 actuates a timer (not shown) with reference to a detection signal of the sheet discharge sensor S2, and halts the sheet discharge roller 25 and roller 38 after a lapse of predicted time that the sheet is carried into the holding path P3 (St 07*f*). This state is shown in FIG. 7B, where the control CPU 65 moves backward the sheet discharge roller 25 in the opposite direction to the sheet discharge direction, further rotates backward the roller 38 of the holding path P3 in the opposite direction to the sheet discharge direction, and guides the sheet to the holding path P3.

Figure 7C:
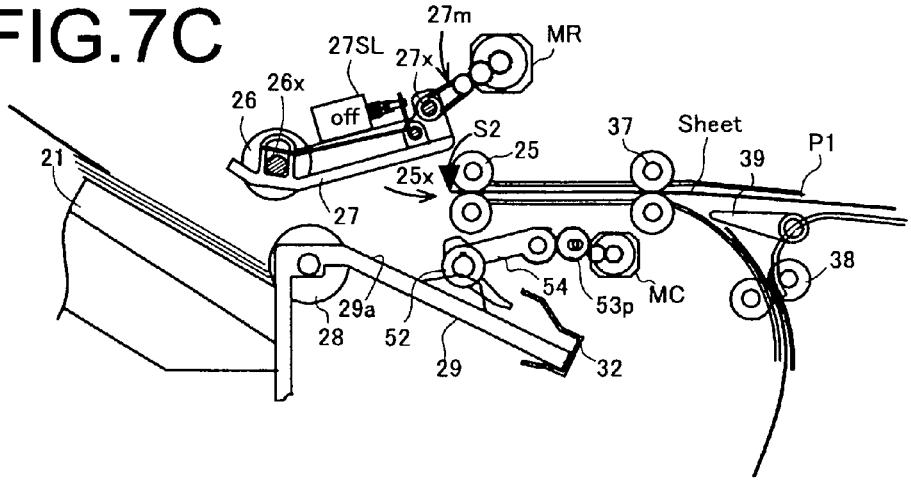

Next, the control CPU 65 monitors whether or not a subsequent sheet Sr is fed to the carry-in entrance 23*a*, and when the sheet sensor S1 detects the sheet front end (St 07*g*), returns the flapper 39 to the solid-line state in FIG. 2, while rotating the transport roller 37 and the sheet discharge roller 25. Then, when the sheet discharge sensor S2 detects the front end of the subsequent sheet (St 07*h*), the control CPU 65 halts the sheet discharge roller 25 (St 07*i*). This state is shown in FIG. 7C.

Figure 8A:
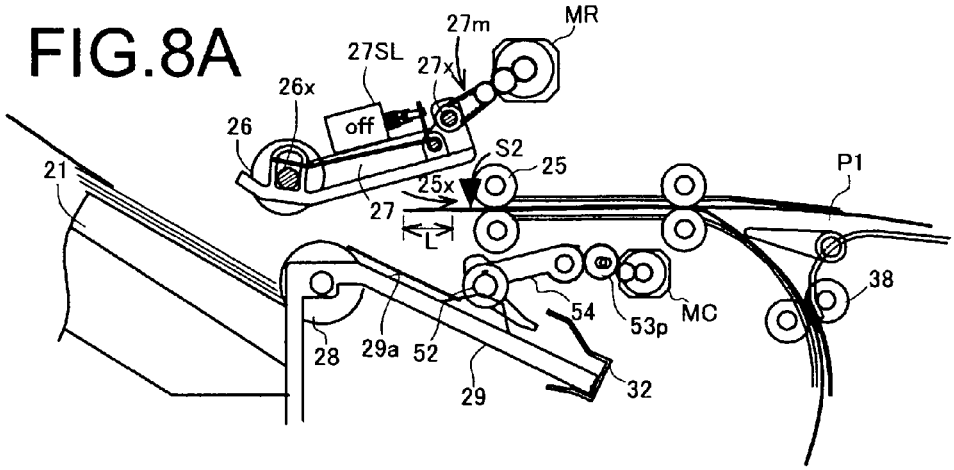
FIGS. 8A, 8B and 8C show a procedure of overlapping the sheet in the holding path with a subsequent sheet to transport to the processing tray.

Next, the control CPU 65 shifts the flapper 39 to the dashed-line state in FIG. 2 with the subsequent sheet Sr nipped and held by the sheet discharge roller 25, and rotates the roller 38 of the holding path P3 in the sheet discharge direction (St 07*j*). This state is shown in FIG. 8A, where the prior sheet Sf is fed to under the subsequent sheet Sr and overlapped in the position of the sheet discharge roller 25. Then, the control CPU 65 actuates a timer with reference to a detection signal that the sheet discharge sensor S2 detects the front end of the prior sheet Sf (St 07*k*). This timer is set for the predicted time that the front end of the prior sheet Sf held in the holding path P3 reaches the position of the sheet discharge roller 25. After a lapse of the timer time, the control CPU 65 rotates the sheet discharge roller 25 in the sheet discharge direction. Then, the prior sheet Sf is overlapped with under the subsequent sheet Sr, and a distance L is formed between both of the sheets (see FIG. 8A).

Figure 8B:
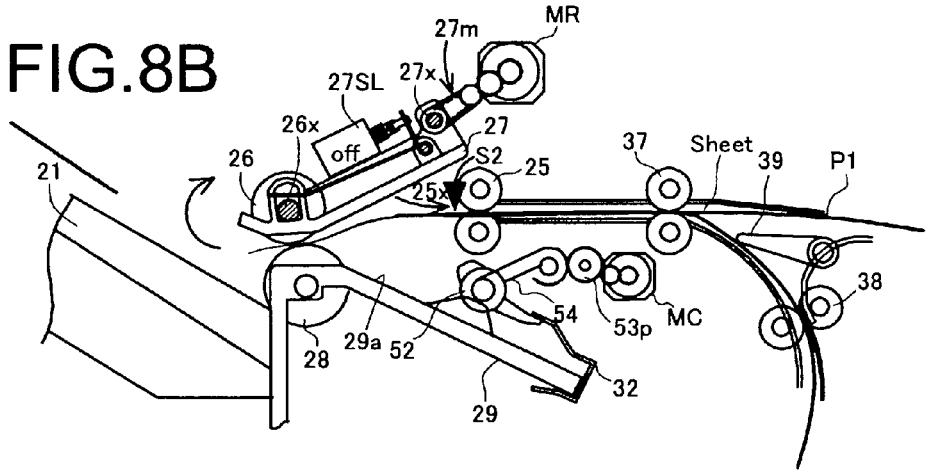

Next, the control CPU 65 actuates the timer 1 with reference a signal that the sheet discharge sensor S2 detects the front end of the subsequent sheet. This timer 1 is set for the predicted time that the prior sheet Sf is overlapped with under the subsequent sheet and that the sheet front end reaches the alignment roller 26 on the processing tray. Then, after a lapse of the set time of the timer 1, the control CPU 65 moves (downward) the alignment roller 26 to the operating position from the standby position (St 11), and rotates the alignment roller 26 in the sheet discharge direction (St 12). This state is shown in FIG. 8B, where a plurality of overlapped sheets fed from the sheet discharge outlet moves forward in the sheet discharge direction.

Figure 8C:
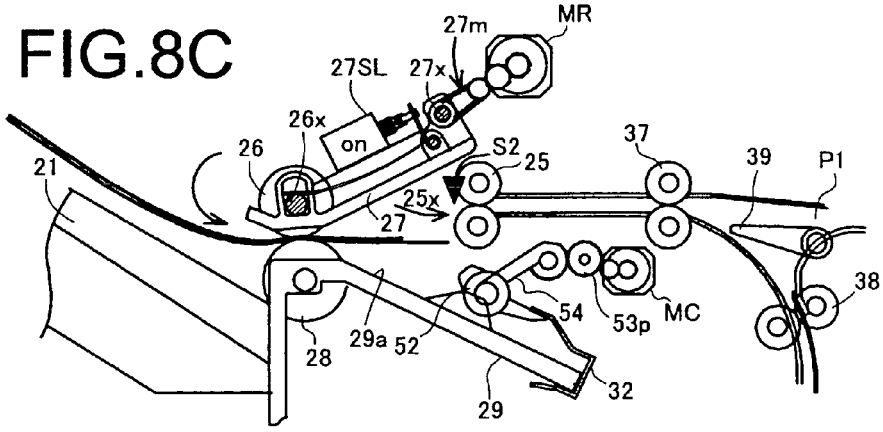

Next, the control CPU 65 monitors whether or not the sheet rear end is passed through the sheet discharge sensor S2 (St 13). Then, the control CPU 65 halts the alignment roller 26 with reference to a detection signal (sensor OFF) from the sheet discharge sensor S2, and rotates backward the alignment roller 26 in the opposite direction to the sheet discharge direction (St 14*a*). At this point, in tandem with the backward rotation of the alignment roller 26, the control CPU 65 applies the power to the operating solenoid 27SL so that the return spring 27SLb presses the alignment roller 26. At this point, the alignment roller 26 exerts the pressing force Pw2 (roller's weight+spring pressure) on the sheets, and the transport force applied to the sheets is set at the strong force (St 14*b*). This state is shown in FIG. 8C, where rear ends of the overlapped sheets are carried onto the processing tray, and the alignment roller 26 starts feeding of the sheets to the rear-end regulation stopper 32. At this point, the alignment roller 26 exerts the pressing force Pw2 on the sheets.

Figure 9A:
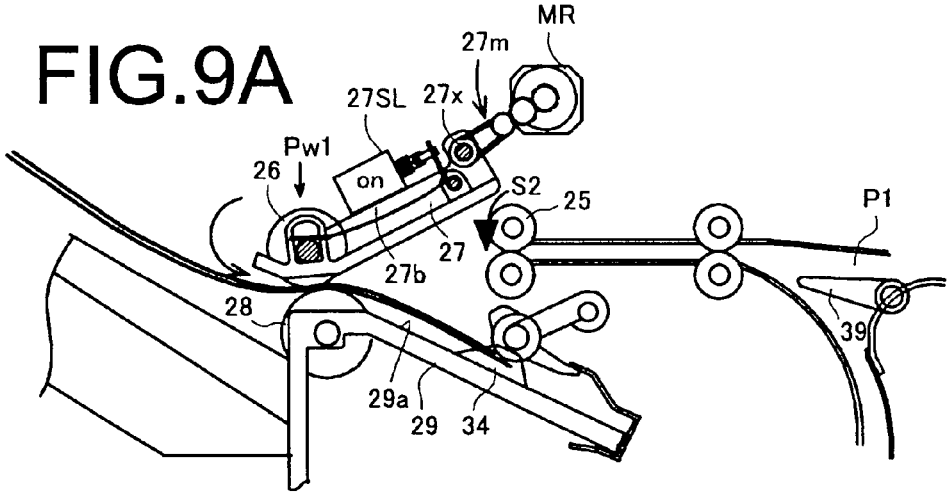
FIGS. 9A, 9B and 9C show a procedure of forcing sheets that are overlapped and transported onto the processing tray to strike the regulation stopper to align.
Figure 9B:
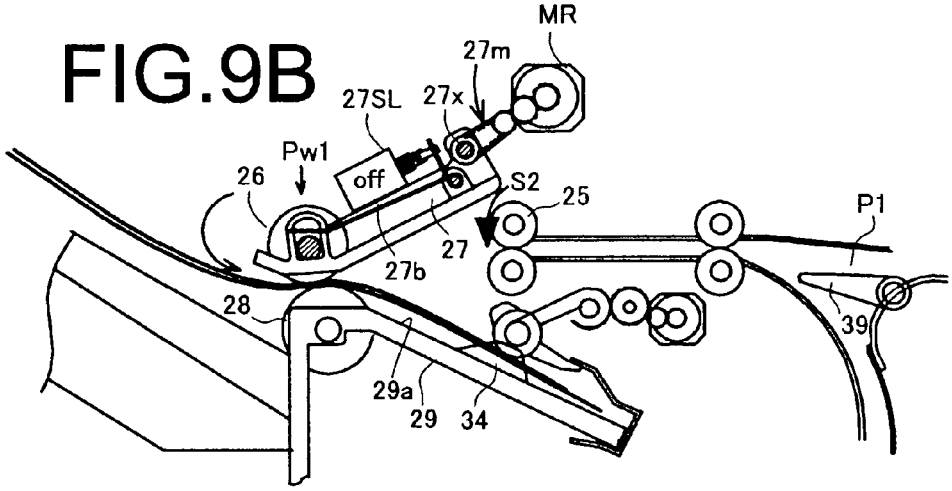

Next, concurrently with the backward rotation of the alignment roller 26, the control CPU 65 actuates a time 4. This timer 4 is set for the predicted time that the sheet rear ends engage in the sheet pressing guide 50. This state is shown in FIG. 9A. A plurality of overlapped sheets in this state is inserted between the sheet pressing guide 50 and the uppermost sheet on the processing tray, and is provided with the strong transport force.

Figure 9C:
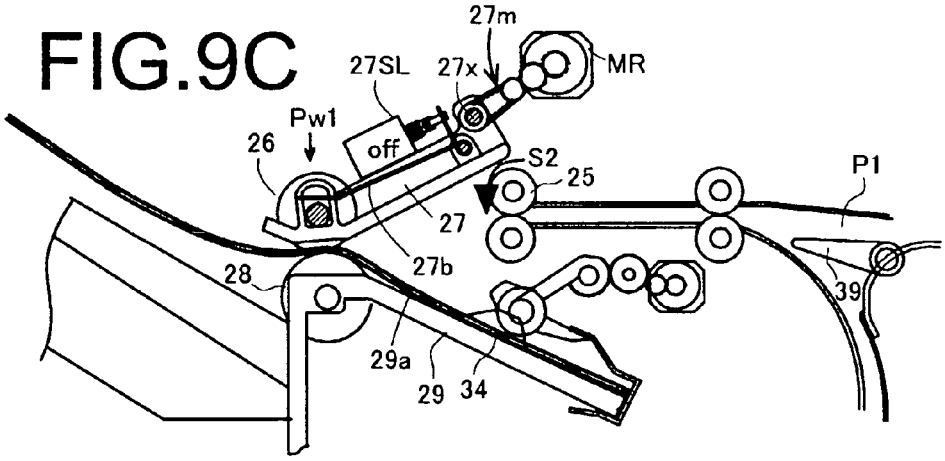

Next, the control CPU 65 halts the alignment roller using an up signal from the timer 4 activated concurrently with the backward rotation of the alignment roller 26 (St 16). This timer time is set for the predicted time that the sheet rear ends reach the rear-end regulation stopper 32. This state is shown in FIG. 9C.

In addition, a sheet fed from the image formation apparatus A during the time the post-processing is performed on the processing tray 29 is temporarily held in the holding path P3, and transported to the processing tray 29 concurrently with a sheet fed after the post-processing is finished. Described is the case that a single sheet is held in the holding path P3 at this point, but it is possible to adopt a configuration that a plurality of sheets is held and kept in the holding path P3.

What is claimed is:

1. A sheet collecting apparatus comprising:

a sheet transport path for transporting a sheet from a carry-in entrance to a predetermined sheet discharge outlet;

a tray device for bearing and storing sheets from the sheet discharge outlet;

a regulation stopper for regulating the sheet by an end edge of the sheet fed onto the tray device striking the regulation stopper;

a holding path provided in the sheet transport path to temporarily hold the sheet from the carry-in entrance so as to overlap with a subsequent sheet to carry out of the sheet discharge outlet;

an alignment roller disposed above the tray device to transport the sheet fed from the sheet discharge outlet to the regulation stopper; and a control device for controlling transport of the sheet from the carry-in entrance to the regulation stopper, wherein the alignment roller is provided with a pressing force adjustment device for adjusting a level of pressing force acting on the sheet transported onto the tray device, the control device is comprised of a first operation mode for transporting the sheet fed from the carry-in entrance to the regulation stopper without holding in the holding path, and a second operation mode for holding the sheet fed from the carry-in entrance in the holding path to overlap with the subsequent sheet, and feeding the sheets to the regulation stopper, and in the first operation mode, the alignment roller applies a transport force to the sheet by a predetermined pressing force after a rear end of the sheet is carried into the tray device, while in the second operation mode, for a period during which rear ends of overlapped sheets are carried into the tray device and then reach the regulation stopper, changing the pressing force applied to the sheets from the alignment roller from a first pressing force which is stronger than the predetermined pressing force to a second pressing force which is weaker than the first pressing force and thereby applying the varied transport force.

2. The sheet collecting apparatus according to claim 1, wherein the alignment roller is configured to move the sheet carried onto the tray device forward by a predetermined distance in a sheet discharge direction, and then, to move the sheet backward in an opposite direction to the sheet discharge direction so that the sheet strikes the regulation stopper and is aligned.

3. The sheet collecting apparatus according to claim 1, wherein the tray device has a sheet mount surface shorter than a length in a sheet discharge direction of a maximum size sheet that can be mounted on the tray device, and on the sheet mount surface is disposed a driven roller opposed to the alignment roller.

4. The sheet collecting apparatus according to claim 1, wherein the regulation stopper is disposed to regulate a rear end edge in a sheet discharge direction of the sheet on the tray device, and a sheet mount surface of the tray device is inclined so as to lower the regulation stopper side gradually, and in cooperation with the transport force of the alignment roller, forces the sheet to strike the regulation stopper to align.

5. The sheet collecting apparatus according to claim 1, wherein the alignment roller is supported by a roller lifting/lowering device for supporting the alignment roller to be able to move up and down between an operating position in which the alignment roller comes into contact with an uppermost sheet and a standby position in which the alignment roller is withdrawn above the sheet with respect to the tray device, and the roller lifting/lowering device is provided with a driving device for lifting and lowering the alignment roller between the operating position and the standby position, and with the pressing force adjustment device for reducing the pressing force applied to the uppermost sheet from the alignment roller.

6. A post-processing apparatus comprising:

a sheet collecting apparatus for bearing and storing sheets from a sheet discharge outlet on a tray device;

a post-processing device disposed in the tray device to perform post-processing including binding processing, folding processing and punching processing on a bunch of collected sheets; and a stack tray for storing the sheets subjected to the post-processing in the tray device, wherein the stack tray is disposed on a downstream side of the tray device so as to support a front end portion of the sheets supported at a rear end portion of the sheets by the tray device, and the sheet collecting apparatus has a configuration according to claim 1.

7. An image formation system comprising:

an image formation apparatus for forming images on sheets sequentially; and a post-processing apparatus for collecting the sheets from the image formation apparatus on a collection tray to perform post-processing, wherein the post-processing apparatus has a configuration according to claim 6.

* * * * *